United States Patent [19]

Velazquez

[11] 3,971,495

[45] July 27, 1976

[54] COMBINATION PACK FRAME AND BED

[76] Inventor: Pedro A. Velazquez, 231-48 Mentone Ave., Laurelton, N.Y. 11413

[22] Filed: July 1, 1974

[21] Appl. No.: 484,979

[52] U.S. Cl. ..... 224/10; 5/113; 5/114; 135/1 R

[51] Int. Cl.[2] ..... A45F 4/00

[58] Field of Search ..... 224/8 R, 9, 10, 25 A; 5/113, 114; 135/1 R

[56] References Cited

UNITED STATES PATENTS

| | | | |
|---|---|---|---|
| 3,730,407 | 5/1973 | Russell | 224/9 |
| 3,828,992 | 8/1974 | Cerchione | 224/9 |
| 3,848,279 | 11/1974 | Ipsen | 5/113 |

*Primary Examiner*—Robert G. Sheridan
*Attorney, Agent, or Firm*—Howard I. Podell

[57] ABSTRACT

A combination camper's tent, cot and pack frame, formed of a light telescopic shaped tubular frame to which a fabric in the form of a sleeping bag and cover is fastened. The telescopic tubular frame pulls apart to form the support for the bed in the extended mode and nests together to form a pack frame, in the folded mode. A pouch is fitted on one surface of the pack and serves to hold clothes and supplies.

4 Claims, 3 Drawing Figures

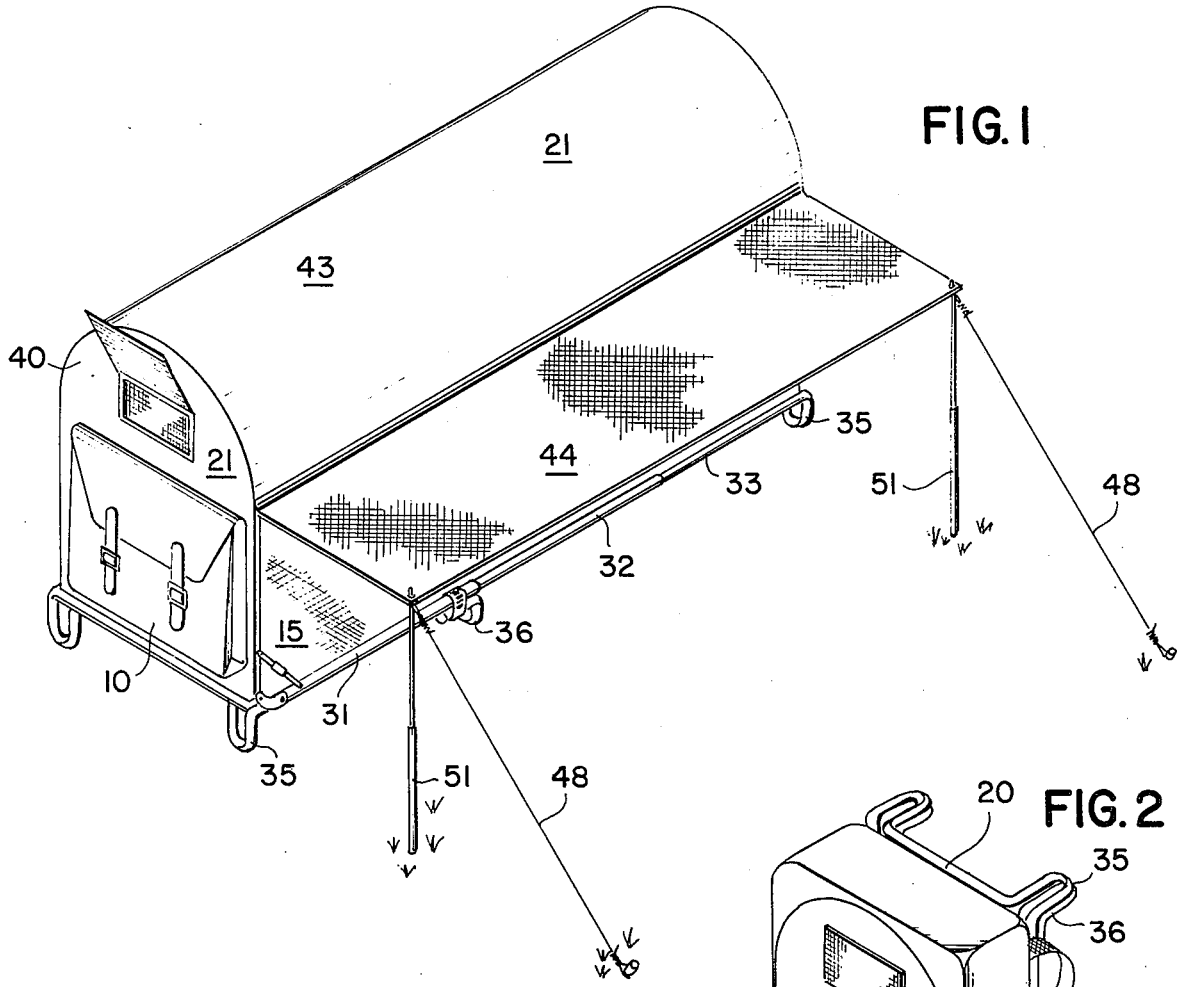
FIG. 1
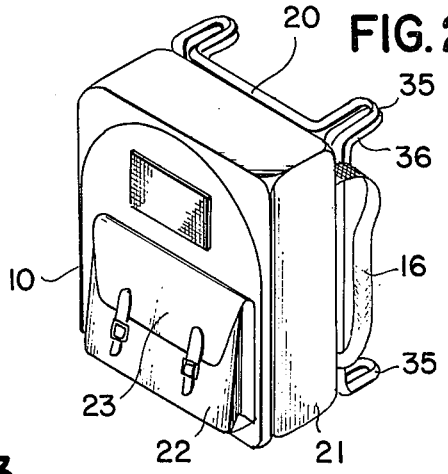
FIG. 2
FIG. 3
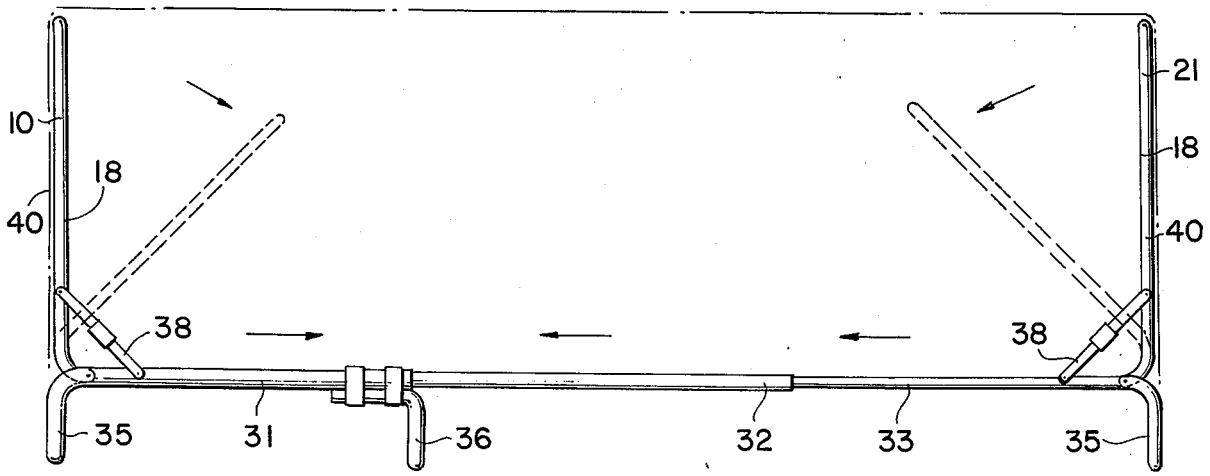

COMBINATION PACK FRAME AND BED

SUMMARY OF THE INVENTION

My invention relates to a combination camper's tent, cot and pack frame which utilizes a light tubular telescopic frame and to which a fabric is attached for forming a tent, cot and a sleeping bag.

When extended, the telescopic pack frame forms the legs and support structure for the sleeping bag cot. When folded up, the metal sections of the frame nest together to form a pack frame, and the tent cover and sleeping bag cot forms a pack bag. A pouch on one end of the pack cover holds food, clothing, and other supplies.

This unit provides the protection of a tent and sleeping bag, with greater comfort, while weighing less than a conventional tent cot and sleeping bag.

BRIEF DESCRIPTION OF THE DRAWING

The objects and features of the invention may be understood with reference to the following detailed description of an illustrative embodiment of the invention, taken together with the accompanying drawings in which:

FIG. 1 is a perspective view of the invention in use as a tent and cot;

FIG. 2 is a perspective view of the unit set up as a pack; and

FIG. 3 is a side view of the unit set up as a tent and cot.

DESCRIPTION OF THE PREFERRED EMBODIMENT

Turning now descriptively to the drawings, in which similar reference characters denote similar elements throughout the several views, FIG. 2 illustrates the back pack 10 which is of a conventional size and shape in the folded mode, being formed of a tubular frame 20 to which canvas or duck fabric 21 is fastened with an external pocket 22 and flap 23 in which supplies may be carried, and fitted with fastening straps 16.

As shown in FIGS. 1 and 3, the frame 20 is formed of telescopic tubular members 31, 32, and 33, with tubular members 31 and 33 shaped with end leg sections 35 and tubular section 32 nesting between the end members 31 and 33. Tubular end member 31 which forms the external tube, when the frame is nested together, is fitted with a set of auxilliary bent leg sections 36 at its open end which serve to support the more middle sections of the unit in the extended mode.

A fabric sheeting 15 serves as the cot and is fastened to the tubular members.

Each end member 31 and 33 of the frame is pivotably fastened to a U-shaped end frame 18 to which the fabric 21 is fastened, and fastened by foldable angle brackets 38 so that in the extended mode, the U-shaped end frames may be pivoted perpendicular to the axis of the tubular frame members 31 and 33 to form the end walls 40 of the sleeping tent, with the fabric 21 shaped so that in the extended mode, the remainder of the fabric is stretched out to form the side walls and roof 43 of the tent, with a flap section 44 that may be folded in a horizontal plane and mounted on telescopic stakes 51 to serve as a side cover of the tent. Guy wires 48 may be also fastened to the telescopic stakes for greater security.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A combination sleeper's cot and tent that may be folded up into a pack frame comprising a tubular frame section formed of telescopic members that may be extended to form the frame of a cot, and fabric fastened to the frame section which in the extended position of the frame serves as a cot, with the fabric forming the sides of a back pack when the telescopic members are nested together, in which the tubular frame section is formed of a first end member in the form of a U-shaped section, formed of two parallel leg sections joined to a common mid-section, two tubular rods, each of which is telescopically engaged inside a leg section of the said first end member, and a second end section similar in shape to the said first U-shaped section, with each leg section of said second section telescopically engaged inside one of said tubular rods, with each end section shaped, adjacent the juncture of the midsection to the leg section, to form a U-shaped support section, the plane of which extends generally perpendicular to the plane of the end section, said support sections serving as legs of the cot formed by telescopically extending the end sections apart from each other.

2. The combination as recited in claim 1 in which a U-shaped support section is fixed to the end of each leg section of the first end section adjacent the joint with the telescopic rod, said support rods serving as auxilliary legs for the cot formed when the end sections are telescopically extended apart from each other, with each of said U-shaped support sections lying adjacent to a U-shaped support of the second end section when the end sections are telescopically retracted together.

3. The combination as recited in claim 1 in which a U-shaped member is pivotably fastened to the end section of each end member of the frame, said U-shaped members in the folded condition lying parallel to the frame axis, with means to hold each U-shaped member perpendicular to the frame axis so that each U-shaped member serves as the frame for an end wall, said end walls being formed of the pack fabric fastened about the U-shaped frame members.

4. The combination as recited in claim 1 in which the pack fabric is fastened to the frame and U-shaped members so as to serve as a tent roof and tent sides when the U-shaped members are erected perpendicular to the frame axis.

* * * * *